US011238766B2

(12) United States Patent
Seo

(10) Patent No.: US 11,238,766 B2
(45) Date of Patent: Feb. 1, 2022

(54) DISPLAY DEVICE AND METHOD OF DRIVING THE SAME

(71) Applicant: Samsung Display Co., Ltd., Yongin-Si (KR)

(72) Inventor: Hae Kwan Seo, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/929,012

(22) Filed: Jul. 14, 2020

(65) Prior Publication Data

US 2021/0097912 A1 Apr. 1, 2021

(30) Foreign Application Priority Data

Sep. 30, 2019 (KR) ..... 10-2019-0120871

(51) Int. Cl.

| | |
|---|---|
| ***G09G 3/00*** | (2006.01) |
| ***G09G 3/3275*** | (2016.01) |
| ***G09G 3/3266*** | (2016.01) |

(52) U.S. Cl.

CPC ..... *G09G 3/007* (2013.01); *G09G 3/3266* (2013.01); *G09G 3/3275* (2013.01); *G09G 2320/045* (2013.01); *G09G 2330/023* (2013.01); *G09G 2340/0464* (2013.01)

(58) Field of Classification Search

CPC ..... G09G 2320/02; G09G 2320/0257; G09G 2320/046; G09G 3/007

See application file for complete search history.

(56) References Cited

U.S. PATENT DOCUMENTS

| | | | | |
|---|---|---|---|---|
| 10,394,515 | B2 | 8/2019 | Park | |
| 2012/0113084 | A1* | 5/2012 | Yang | G09G 3/3655 345/212 |
| 2015/0228088 | A1 | 8/2015 | Yoon et al. | |
| 2018/0012530 | A1* | 1/2018 | Lee | G09G 3/2085 |
| 2018/0088892 | A1* | 3/2018 | Park | G06F 3/1431 |
| 2018/0240260 | A1* | 8/2018 | Lee | G06F 1/3293 |
| 2019/0066633 | A1* | 2/2019 | Zhu | G06F 1/3265 |

FOREIGN PATENT DOCUMENTS

| | | |
|---|---|---|
| KR | 10-2015-0095051 A | 8/2015 |
| KR | 10-2018-0035978 A | 4/2018 |
| KR | 10-2018-0095409 A | 8/2018 |

* cited by examiner

*Primary Examiner* — Roy P Rabindranath

(74) *Attorney, Agent, or Firm* — Innovation Counsel LLP

(57) ABSTRACT

A display device may include a pixel, a driver unit, and a memory. The pixel unit may display a first image in a first mode and may display a second image in a second mode. The driver unit may be electrically connected to the pixel unit, may provide data signals corresponding to the first image to the pixel unit in response to a first mode start signal, may generate first position data including position information of the first image in response to a first mode end signal, and may enable the pixel unit to shift the first image at a predetermined period in the first mode. The memory may be electrically connected to the driver unit and may store the first position data.

14 Claims, 7 Drawing Sheets

DISPLAY DEVICE AND METHOD OF DRIVING THE SAME

CROSS-REFERENCE TO RELATED APPLICATION

The application claims priority to and the benefit of Korean Patent Application No. 10-2019-0120871, filed Sep. 30, 2019; the Korean Patent Application is incorporated by reference.

BACKGROUND

Field

The technical field may relate to a display device and a method of driving the display device.

Related Art

A display device may be in a standby state (or standby mode) when the user of the display device does not actively use the display device. The display device may display an image at low power in the standby state.

The standby state of the display device may last for several hours or more. The pixels displaying the image in the standby state may deteriorate faster than other pixels of the display device.

SUMMARY

Embodiments may be related a display device capable of controlling a position of an image displayed in a first mode every time the display device enters the first mode.

Embodiments may be related to a method of driving the display device.

Embodiments may be related to an electronic device including the display device.

A display device according to an embodiment may include a pixel unit displaying a first image in a first mode and displaying a second image in a second mode; a driver unit providing a data signal corresponding to the first image to the pixel unit in response to a first mode start signal, generating first position data including position information of the first image in response to a first mode end signal, and shifting the first image at a predetermined period in the first mode; and a memory for storing the first position data.

According to an embodiment, the first position data may be position information on which the first image is displayed when the first mode ends.

According to an embodiment, the first position data may correspond to one of reference coordinates of the pixel unit determined according to a predetermined shift scenario.

According to an embodiment, the driver unit may shift the first image in the order set in the reference coordinates during the first mode.

According to an embodiment, a last position of the first image displayed in the first mode which is currently activated may be different from a first position of the first image displayed in the first mode which is subsequently activated again.

According to an embodiment, the driver unit may load the first position data from the memory in response to the first mode start signal and generate second position data that determines a position at which the first image is to be displayed using the first position data when the first mode is resumed.

According to an embodiment, the driver unit may determine the position of the first image as a position where the second position data is reflected in response to the first mode start signal.

According to an embodiment, the driver unit may shift the first image according to a shift scenario, starting with coordinates corresponding to the second position data during the first mode.

According to an embodiment, the second position data may include second coordinates corresponding to positions to which the first image is shifted from first coordinates corresponding to the first position data by a shift scenario.

According to an embodiment, the memory may be a non-volatile memory.

According to an embodiment, the driver unit may count a number of times that position defining pixel coordinates defining a position of the first image matches the reference coordinates, respectively. The memory may accumulate and store counted values for each of the reference coordinates.

According to an embodiment, the pixel unit may display an always on display image in the first mode.

According to an embodiment, the driver unit may include an image shifter shifting first image data corresponding to the first image according to a predetermined shift scenario in the first mode; a data driver converting the first image data to the data signal and providing the data signal to the pixel unit through a data line; and a scan driver providing a scan signal to the pixel unit through a scan line.

According to an embodiment, the image shifter may include a position data generator loading the first position data from the memory in response to the first mode start signal and generating the second position data that determines the position at which the first image is to be displayed using the first position data; and a shifting updater shifting the first image data by using the second position data.

According to an embodiment, the shifting updater may shift the first image according to the predetermined shift scenario, starting with the reference coordinates corresponding to the second position data in the first mode.

According to an embodiment, the image shifter may further include a shift counter counting the number of times that the position defining pixel coordinates defining the position of the first image are matched with respect to each of the reference coordinates each time the first image is shifted, and storing counted values in the memory.

A method of driving a display device according to an embodiment may include generating first position data including position information of a first image currently being displayed in response to a first mode end signal and storing the first position data in a memory; reading the first position data from the memory in response to a first mode start signal, and generating second position data that determines a position at which the first image is to be displayed using the first position data; and displaying the first image based on the second position data in the first mode.

According to an embodiment, the method of driving the display device may further include shifting the first image according to a predetermined shift scenario, starting with coordinates corresponding to the second position data during the first mode.

According to an embodiment, the second position data may include information of second coordinates, which are positions to be moved by the shift scenario from first coordinates corresponding to the first position data.

According to an embodiment, the first image displayed in the first mode may be an always on display image.

An embodiment may be related to a display device. The display device may include a pixel, a driver unit, and a memory. The pixel unit may display a first image in a first mode and may display a second image in a second mode. The driver unit may be electrically connected to the pixel unit, may provide data signals corresponding to the first image to the pixel unit in response to a first mode start signal, may generate first position data including position information of the first image in response to a first mode end signal, and may enable the pixel unit to shift the first image at a predetermined period in the first mode. The memory may be electrically connected to the driver unit and may store the first position data.

The first position data may correspond to a position of the first image in the pixel unit when a session of the first mode ends.

The first position data may correspond to one set of reference coordinate sets of the pixel unit determined according to a predetermined shift scenario.

The driver unit may provide signals for the pixel unit to shift the first image in an order corresponding to the reference coordinate sets during a current session of the first mode.

A last position of the first image displayed in a previous session of the first mode may be different from a first position of the first image displayed in a current session of the first mode that is subsequent to the previous session of the first mode.

The driver unit may load the first position data from the memory in response to the first mode start signal. The driver unit may use the first position data to generate second position data that determines a position at which the first image is to be displayed when the first mode resumes.

The driver unit may determine the position of the first image according to the second position data in response to the first mode start signal.

The driver unit may enable the pixel unit to shift the first image according to a predetermined shift scenario, starting with coordinates corresponding to the second position data during a current session of the first mode.

The second position data may include second coordinates different from first coordinates according to a predetermined shift scenario. The first coordinates may correspond to a last position of the first image in an immediately preceding session of the first mode.

The memory may be a non-volatile memory.

The driver unit may count a number of occurrences that values of position defining pixel coordinates, which define positions of the first image, match each of the reference coordinate sets. The memory may accumulate and store the number of occurrences.

The pixel unit may display a continuously on display image in the first mode. Power consumption of the pixel unit may be lower in the first mode than in the second mode.

The display device may include the following elements: data lines electrically connected to the pixel unit; and scan lines electrically connected to the pixel unit. The driver unit may include the following elements: an image shifter for shifting first image data corresponding to the first image according to a predetermined shift scenario in the first mode; a data driver for converting the first image data to the data signals and for providing the data signals to the pixel unit through the data lines; and a scan driver for providing scan signals to the pixel unit through the scan lines.

The image shifter may include the following elements: a position data generator obtaining the first position data from the memory in response to the first mode start signal and using the first position data to generate second position data that determines a position at which the first image is to be displayed; and a shifting updater shifting the first image data according to at least the second position data.

In the first mode, the shifting updater may generate shifted first image data for shifting the first image according to the predetermined shift scenario, starting with a reference coordinate set corresponding to the second position data.

The image shifter further may include a shift for counter counting a number of occurrences that values of a position defining pixel coordinate set, which define positions of the first image, match each of reference coordinate sets. The memory may store the number of occurrences.

An embodiment may be related to a method of driving a display device. The method may include the following steps: generating first position data including position information of a first image currently being displayed in response to a first mode end signal; storing the first position data in a memory; reading the first position data from the memory in response to a first mode start signal, wherein the first mode start signal may signal a start of a session of a first mode; generating, using the first position data, second position data that determines a position at which the first image is to be displayed; and displaying the first image in a pixel unit based on the second position data in the beginning of the session of the first mode.

The method may include shifting the first image in the pixel unit according to a predetermined shift scenario.

The second position data may include information of second coordinates different from first coordinates corresponding to the first position data according to a predetermined shift scenario.

The first image displayed in the first mode may be a continuously on display image. Power consumption of the pixel unit may be lower in the first mode than in a second mode.

DETAILED DESCRIPTION

Figure 1:
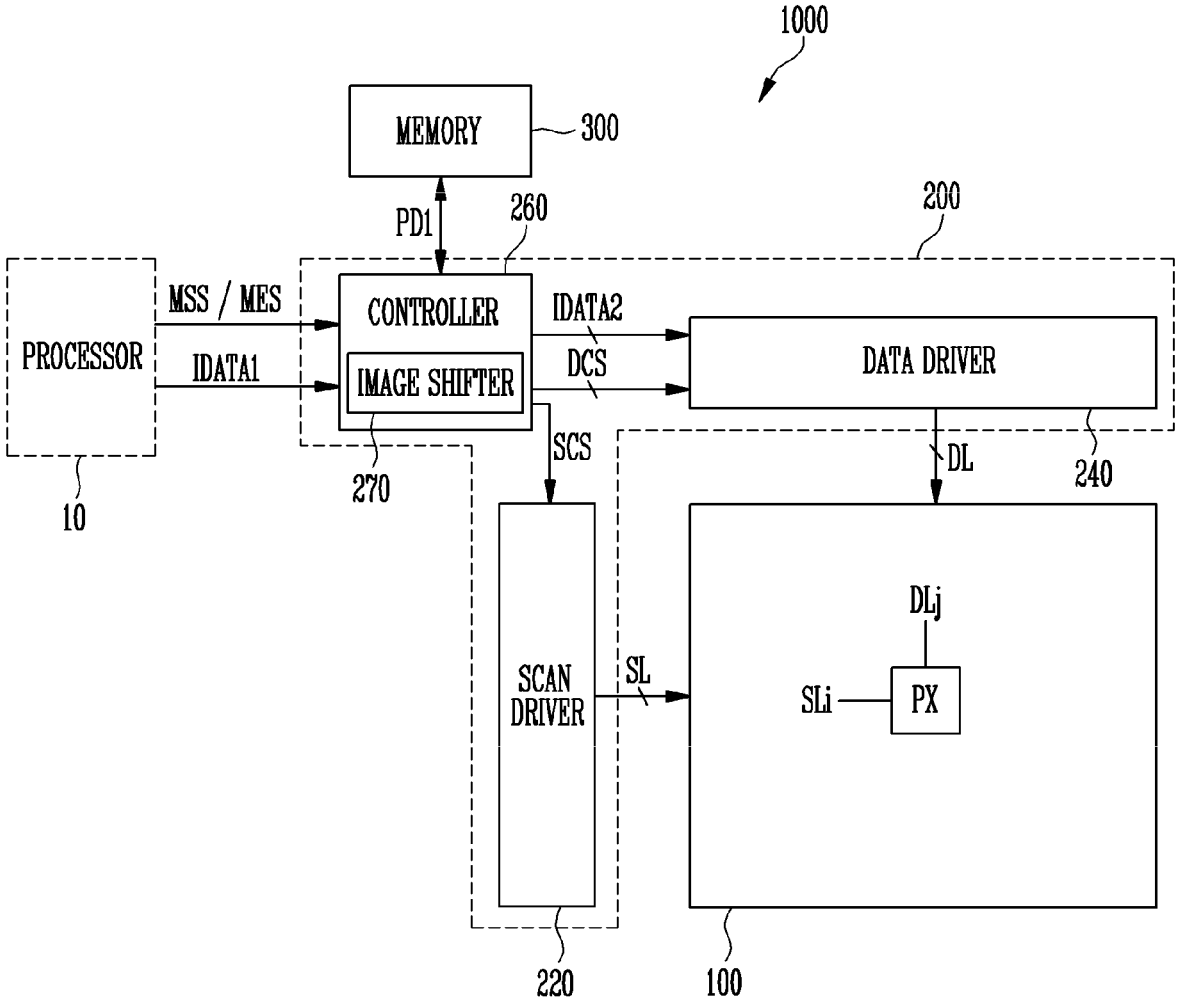
FIG. 1 is a block diagram illustrating a display device according to an embodiment.

Example embodiments are described with reference to the accompanying drawings. The same reference numerals may be used for the same elements in the drawings.

Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set), " "second-type (or second-set)," etc., respectively.

The term "drive" may mean "control" or "operate." The term "connect" may mean "electrically connect." The term "correspond to" may mean "be equal to" or "equal." The term "reference coordinates" may mean "reference coordinate set" or "reference coordinate sets."

FIG. 1 is a block diagram illustrating a display device according to an embodiment.

Referring to FIG. 1, a display device 1000 may include a pixel unit 100, a driver unit 200, and a memory 300. The display device 1000 may further include a power supply supplying predetermined power sets to at least one of the pixel unit 100, the driver unit 200, and the memory 300.

The display device 1000 may display an image according to commands and data supplied from an external processor 10.

The display device 1000 may be a flat panel display device, a flexible display device, a curved display device, a foldable display device, or a bendable display device. The display device 1000 may be or may be included in a transparent display device, a head-mounted display device, a wearable display device, or the like. The display device 1000 may be or may be included in one of various electronic devices, such as a smartphone, a tablet, a smart pad, a TV, a monitor, and the like.

The display device 1000 may be an organic light emitting diode display device, a liquid crystal display device, or the like.

The pixel unit 100 may include scan lines SL, data lines DL, and pixels PX connected to the scan lines SL and the data lines DL. For example, a pixel PX positioned in an i-th (where i is a natural number) pixel row and a j-th (where j is a natural number) pixel column may be connected to an i-th scan line SLi and a j-th data line DLj. The pixel PX may be referred to and recognized as a pixel positioned at (i, j) coordinates in the display device 1000 or in the pixel unit 100. The pixel unit 100 may further include emission control lines for applying an emission control signal to each of the pixels PX. Two or more scan lines may be connected to one pixel PX.

Each of the pixels PX may include an organic light emitting device as a self-light emitting device. Each of the pixels PX may include an inorganic light emitting device including an inorganic light emitting material and/or a quantum dot member.

The pixel unit 100 may operate in a first mode and a second mode. The pixel unit 100 may display a first image in the first mode and may display a second image in the second mode.

The first mode may be a continuous display mode (or a standby image display mode). In the first mode (for example, always on display [AOD] mode or ambient display mode), simple display information (for example, the first image) may be constantly displayed when the display device 1000 is in a standby state. In the first mode, the image may be displayed at low power. For example, in the first mode, the simple display information such as date, time, battery level, and notification may be continuously displayed. Input image data IDATA1 of the first image supplied from the processor 10 may include image information such as date, time, battery level, and the like.

When the display device 1000 is not actively used by the user, the first mode is activated and the first image is displayed. In the first mode, a user is saved from having to turn on the screen of the electronic device (and/or the display device) for viewing basic information. Power consumption of the display device 1000 due to power on/off of the display device 1000 may be reduced.

In the first mode, a driving frequency for displaying the first image may be lowered. For example, the image may be displayed based on the driving frequency of about 1 Hz in the first mode.

The second mode is a driving mode (for example, a normal image display mode) in which the pixel unit 100 normally displays an image according to input image data IDATA1. For example, in the second mode, a normal image (effective image) or a video may be displayed by an input in response to the user's command The input image data IDATA1 supplied from the processor 10 in the second mode may include normal image or video information according to the user's command The driver unit 200 (or a panel driving unit) may supply a data signal corresponding to the first image to the pixel unit 100 in response to a first mode start signal MSS. The driver unit 200 may enable the pixel unit to shift the first image according to a predetermined shift scenario while the pixel unit 100 is driven in the first mode. The driver unit 200 may generate first position data PD1 including position information of the first image in response to a first mode end signal MES. The first position data PD1 may be stored in the memory 300.

In an embodiment, the first position data PD1 may correspond to a position of the first image when the first mode ends. That is, the first position data PD1 may include last position information of the first image displayed in the first mode. According to an embodiment, the first position data PD1 may include position information of a predetermined pixel included in the first image. For example, the first position data PD1 may be the position information of an uppermost left pixel of the pixel area displaying the first image.

The first image may be shifted at a predetermined time interval according to a predetermined shift scenario in the first mode. The shift scenario may define each of the positions where the first image is sequentially moved and displayed. For example, the shift scenario may be set such that the first image uses the entire pixel unit 100. Accordingly, deterioration of the pixels PX due to the display of the first image may proceed uniformly in the entire pixel unit 100.

Positions to which the first image is to be moved may be determined based on predetermined reference coordinates of the pixel unit 100. For example, specific coordinates of the first image (for example, coordinates of the uppermost left pixel of the first image) may be moved according to the shift scenario to correspond to one of the reference coordinates. That is, the specific coordinates of the first image may be moved along the reference coordinates.

Therefore, the first position data PD1 calculated at the end of the first mode may correspond to one of the reference coordinates.

In an embodiment, in the first mode, the driver unit 200 may cause the pixel unit 100 to shift the first image in the order set in the reference coordinates.

According to an image shift technique, the image shift for the first image may be performed by an initialized shift scenario whenever the first mode is resumed (that is, whenever a display device switches from the second mode to the first mode). Therefore, when the first mode starts, the image is always displayed at the same position. Over time, the deterioration of a pixel at the initial start position is more significant than that of pixels at other portions, and thus a luminance difference and a display defect can be visually recognized. In addition, an afterimage may be visually recognized at the initial start position of the first image.

In order to solve the above problem, the display device 1000 may display the first image by setting the first position of the first image displayed in the current session of the first mode (current first mode) to be different from the last position of the first image displayed in the previous session of the first mode. For example, the last position of the first image displayed in the previous session of the first mode and the first position of the first image displayed in the current session of the first mode (current first mode) maintain continuity of a shift scenario. Over time, cumulative stress of the pixels PX caused by the first mode may be substantially uniform.

In an embodiment, the driver unit 200 may read the first position data PD1 from the memory 300 in response to the first mode start signal MSS. The first position data PD1 may include the position information of the first image displayed last in the previous session of the first mode. When the first mode is resumed, the driver unit 200 may generate second position data that determines a position of the first image using the first position data PD1. The driver unit 200 may associate the second position data with the input image data IDATA1 corresponding to the first image. Accordingly, the pixel unit 100 may display the first image based on the reference coordinates corresponding to the second position data. The second position data may include second coordinates corresponding to one or more positions and/or destinations of the first image according to the shift scenario. When the first mode is resumed, the first image may be displayed based on the second coordinates.

When the first mode resumes, the pixel unit 100 may display the first image at a subsequent position relative to the last position of the first image at the end of the previous session of the first mode according to the shift scenario. Thus, even if activation and deactivation of the first mode are repeated, the continuity of the shift scenario can be maintained.

During the current session of the first mode, the driver unit 200 may signal the pixel unit 100 to shift the first image according to the shift scenario, starting with the reference coordinates (that is, the second coordinates) corresponding to the second position data.

The driver unit 200 may include a scan driver 220, a data driver 240, a controller 260, and an image shifter 270.

In an embodiment, the scan driver 220, the data driver 240, and the controller 260 may be integrated into a driving circuit chip. In an embodiment, the scan driver 220 may be disposed directly on a display panel including the pixel unit 100, and the data driver 240 and the controller 260 may be integrated in a circuit chip.

The scan driver 220 may supply scan signals to the scan lines SL based on one or more first control signals SCS provided from the controller 260. The scan driver 220 may simultaneously provide scan signals (which may have a gate-on level) to all of the pixels PX or may sequentially provide scan signals to the scan lines SL (which may be respectively connected to pixel rows).

The data driver 240 may provide data signals (data voltages) to the data lines DL based on one or more second control signals DCS and image data IDATA2 provided from the controller 260. The data driver 240 may convert digital image data IDATA2 into analog data signals, and may provide the data signals to the pixels PX through the data lines DL. The image data IDATA2 may include a grayscale value corresponding to each of the pixels PX.

The controller 260 may receive the input image data IDATA1, a vertical synchronization signal, a horizontal synchronization signal, a main clock signal, a data enable signal, and the like from the processor 10, and may accordingly generate the control signals SCS and DCS and the image data IDATA2. The controller 260 may function as a timing controller of the display device 1000.

The controller 260 may include the image shifter 270 that shifts a position associated with the input image data IDATA1. The first image displayed on the pixel unit 100 may be shifted according to instructions/signals from driving the image shifter 270. For example, the image shifter 270 may shift the image data according to the shift scenario in the first mode. Although the image shifter 270 is included in the controller 260 in FIG. 1, the image shifter 270 may be separate from the controller 260.

The driver unit 200 may further include a light emission driver to control light emission of each of the pixels PX.

The memory 300 may store the first position data PD1. The memory 300 may provide the first position data PD1 to the controller 260 and/or the image shifter 270 in response to the first mode start signal MSS.

The memory 300 may further store (accumulated) life information of the pixels PX, deterioration information, and at least one shift scenario. In an embodiment, the memory 300 may store a cumulative number of times that the first image matches the pixel areas including each of the reference coordinates applied to the shift scenario. Accordingly, the cumulative stress of the pixels PX used to display the image in the first mode may be calculated.

The memory 300 may be a non-volatile memory in which stored information is not erased even when power supply is cut off. For example, the memory 300 may be an erasable programmable read-only memory (EPROM), an electrically erasable programmable read-only memory (EEPROM), a flash memory, or the like. Therefore, even when the power supply to the display device 1000 and/or the related electronic device is cut off, information of the first position data PD1 and usage information (including degradation and stress) may be maintained in the memory 300. In addition, even when the electronic device and/or the processor 10 associated with the display device 1000 is changed or initialized, the display of the image in the first mode may be performed continuously with respect to the previous session of the first mode according to the stored first position data PD1. Accordingly, deterioration difference between pixels due to the first mode and a potential afterimage of the first image may be prevented or minimized.

The display device 1000 according to the embodiments may store the position of the first image in the pixel unit 100 at the end of a session of the first mode, and may determine the position of the first image in the pixel unit when the first mode is resumed for the next session. Therefore, even if the activation and deactivation of the first mode are repeated, the continuity of the shift scenario can be maintained, the cumulative usage of the pixels PX for displaying the first image in the first mode can be substantially uniform, and deterioration deviation between the pixels PX may be minimized to prevent or minimize the afterimage of the first image.

Figure 2A:
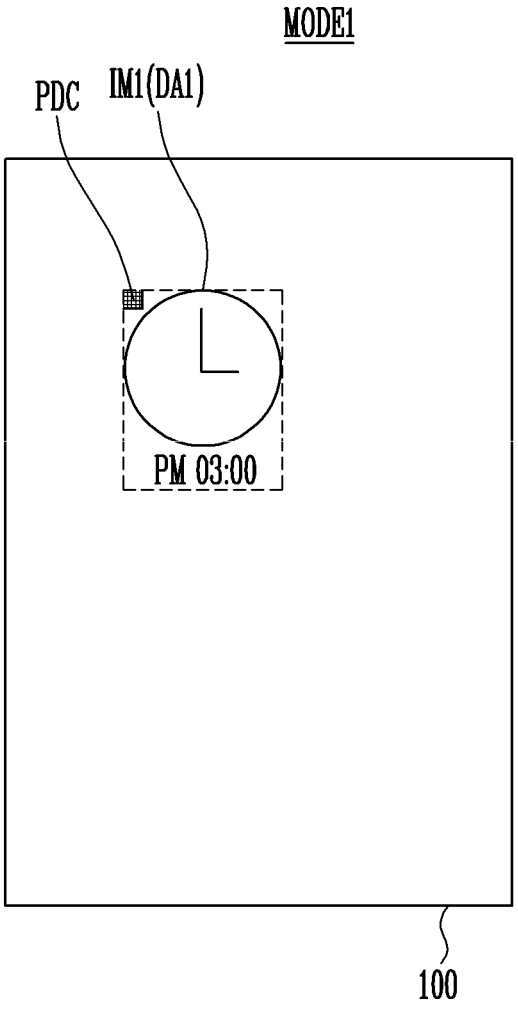
FIG. 2A is a diagram illustrating a first image displayed in a first mode in the display device of FIG. 1 according to an embodiment.
Figure 2B:
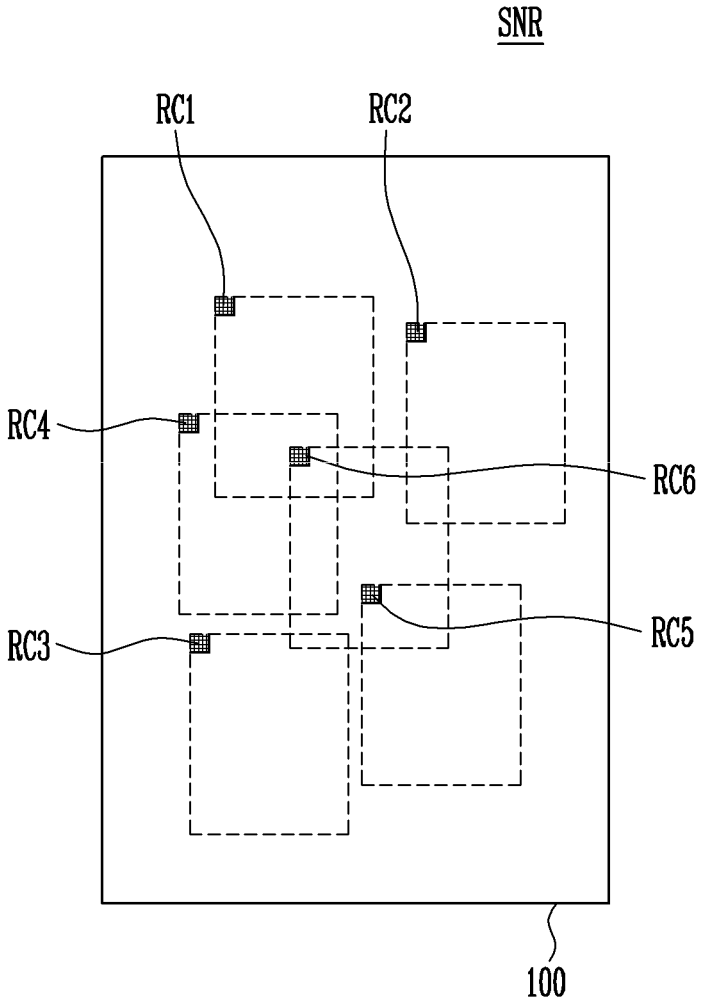
FIG. 2B is a diagram illustrating a shift scenario of the first image of FIG. 2A according to an embodiment.

FIG. 2A is a diagram illustrating a first image displayed in a first mode in the display device of FIG. 1 according to an embodiment. FIG. 2B is a diagram illustrating a shift scenario of the first image of FIG. 2A according to an embodiment.

Referring to FIGS. 1, 2A, and 2B, the pixel unit 100 may display a first image IM1 in (a session of) a first mode MODE1.

The first image IM1 may be shifted and displayed at a predetermined period. In an embodiment, in the first mode MODE1, the first image IM1 may be periodically moved according to a shift scenario SNR.

The first image IM1 may be displayed within a predetermined first area DA1. For example, the driver unit 200 may select the pixels PX included in the first area DA1 for displaying the first image IM1, and may drive the pixel unit 100 based on image data of the first image IM1. The image data of the first image IM1 may be image data of the pixels PX included in the first area DA1.

Referring to FIG. 2A, the first area DA1 may have a rectangular shape or a predetermined polygonal shape. The first area DA1 may have a shape that is sufficient to display the first image IM1.

In an embodiment, coordinates (hereinafter referred to as position defining pixel coordinates PDC) of a predetermined pixel PX in the first area DA1 for displaying the first image IM1 may define a position of the first image IM1. For example, the position defining pixel coordinates PDC may be the coordinates of the pixel PX positioned at the upper-left corner of the first image IM1 and/or of the first area DA1.

The first position data PD1 may include information on the position defining pixel coordinates PDC of the first image IM1 at the end of a session of the first mode MODE1.

Referring to FIG. 2B, the first image IM1 (and the first area DA1) may be moved based on the shift scenario SNR. Reference coordinates (or reference coordinate sets) RC1 to RC6 may be set in the shift scenario SNR. The position defining pixel coordinates PDC of the first image IM1 may be moved in a predetermined order according to the reference coordinates RC1 to RC6. Shift driving of the image data corresponding to the first image IM1 may be performed based on the position defining pixel coordinates PDC. For example, the position defining pixel coordinates PDC may be moved in the order of the first reference coordinates RC1→the second reference coordinates RC2→the third reference coordinates RC3→the fourth reference coordinates RC4→the fifth reference coordinates RC5→the sixth reference coordinates RC6→the first reference coordinates RC1.

According to the shift scenario SNR, the first image IM1 may be displayed such that the position defining pixel coordinates PDC correspond to (and/or are equal to) the first reference coordinates RC1. When a predetermined time (length) elapses, the first image IM1 may be moved such that the position defining pixel coordinates PDC correspond to the second reference coordinates RC2. Thereafter, when the predetermined time elapses, the first image IM1 may be moved such that the position defining pixel coordinates PDC correspond to the third reference coordinates RC3. The first image IM1 may be sequentially moved such that the position defining pixel coordinates PDC sequentially correspond to the fourth reference coordinates RC4, the fifth reference coordinates RC5, and the sixth reference coordinates RC6. After the predetermined time elapses, the first image IM1 corresponding to the sixth reference coordinates RC6 may be moved again such that the position defining pixel coordinates PDC correspond to the first reference coordinates RC1. The image shift operation as described above may be repeated. That is, the position defining pixel coordinates PDC may be moved to correspond to one of the first to sixth reference coordinates RC1 to RC6 according to the shift scenario SNR.

The number and positions of the reference coordinates may be configured according to embodiments. For example, the shift operation of the first image IM1 may be performed in the form of a zigzag pattern, a spiral pattern, or the like.

The first position data PD1 may correspond to one of the reference coordinates RC1 to RC6. The first position data PD1 may include the position defining pixel coordinates PDC of the first image IM1 displayed when a session of the first mode MODE1 ends. The position defining pixel coordinates PDC may be one of the reference coordinates RC1 to RC6.

For example, when a session of the first mode MODE1 ends while the position defining pixel coordinates PDC correspond to the third reference coordinates RC3, the first position data PD1 may include the third reference coordinates RC3. Thereafter, when the first mode is resumed, the first image IM1 may be displayed such that the position defining pixel coordinates PDC correspond to (and/or are equal to) the fourth reference coordinates RC4. Therefore, in the first mode MODE1, all the pixels PX may be used with substantially uniform frequencies.

Figure 3:
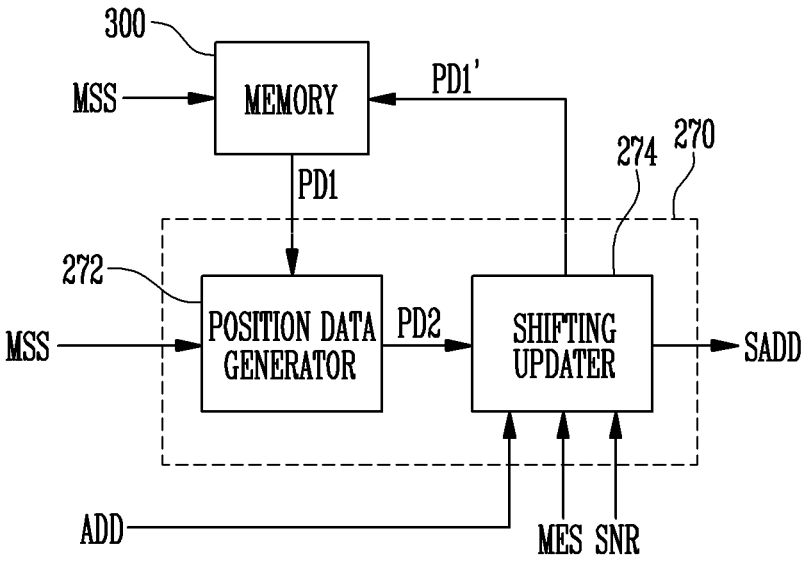
FIG. 3 is a block diagram illustrating an image shifter included in the display device of FIG. 1 according to an embodiment.

FIG. 3 is a block diagram illustrating an image shifter included in the display device of FIG. 1 according to an embodiment.

Referring to FIGS. 2A, 2B, and 3, the image shifter 270 may include a position data generator 272 and a shifting updater 274.

The position data generator 272 may load the first position data PD1 from the memory 300 in response to the first mode start signal MSS. The first position data PD1 stored in the memory 300 may be the position data of the first image IM1 generated at the end of the previous session of the first mode. The first mode start signal MSS may be provided to the position data generator 272 in response to the start of a session of the first mode.

The position data generator 272 may generate second position data PD2 using the first position data PD1. The second position data PD2 may determine a position at which the first image IM1 is to be displayed when the first mode is resumed. For example, when the first position data PD1 includes the third reference coordinates RC3, the position data generator 272 may generate the second position data PD2 including the information of the fourth reference coordinates RC4. The second position data PD2 may be provided to the shifting updater 274.

The shifting updater 274 may shift first image data ADD corresponding to the first image IM1 based on the shift scenario SNR and the second position data PD2 to generate shifted first image data SADD. The shifting updater 274 may receive the first image data ADD from the controller 260 or the processor 10 of FIG. 1. The shifted first image data SADD may be supplied to the data driver 240.

In a session of the first mode, the shifting updater 274 may generate shifted first image data SADD for shifting the first image IM1 according to the shift scenario SNR, starting with the reference coordinates corresponding to the second position data PD2. Accordingly, the position defining pixel coordinates PDC may be changed (or updated) at a predetermined time interval. For example, the position defining pixel coordinates PDC for the first image IM1 may be moved to correspond to one of the reference coordinates in the order set in the shift scenario SNR.

The shift of the first image IM1 may be performed according to various image shift methods.

In an embodiment, when (a session of) the first mode is deactivated and (a session of) the second mode is activated, the first mode end signal MES may be generated. The first mode end signal MES may be supplied to the shifting updater 274. The shifting updater 274 may determine the reference coordinates corresponding to the current position defining pixel coordinates PDC as new first position data PD1' in response to the first mode end signal MES. The new first position data PD1' may be stored in the memory 300.

The memory 300 may accumulate and store the new first position data PD1' whenever the first mode is deactivated (or ends). The memory 300 may provide the position data generator 272 with the last stored new first position data PD1' as the first position data PD1 in response to the first mode start signal MSS.

Figure 4:
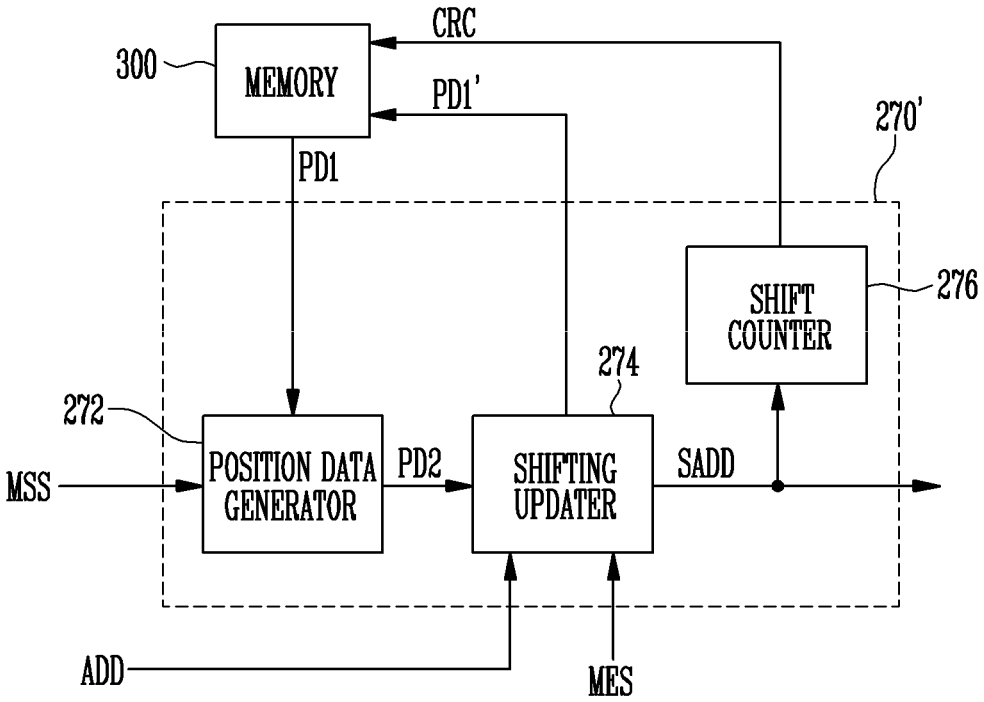
FIG. 4 is a block diagram illustrating an image shifter included in the display device of FIG. 1 according to an embodiment.

FIG. 4 is a block diagram illustrating an image shifter included in the display device of FIG. 1 according to an embodiment.

In FIG. 4, the same reference numerals may be used for the elements described with reference to FIG. 3. An image shifter 270' of FIG. 4 may have a configuration substantially the same as or similar to that of the image shifter 270 of FIG. 3 except for a shift counter 276.

Referring to FIGS. 2A, 2B, and 4, the image shifter 270' may include the position data generator 272, the shifting updater 274, and the shift counter 276.

The position data generator 272 may load the first position data PD1 from the memory 300 in response to the first mode start signal MSS and may generate the second position data PD2 using the first position data PD1.

The shifting updater 274 may shift the first image data ADD corresponding to the first image IM1 based on the shift scenario SNR and the second position data PD2.

Each time the first image IM1 is shifted, the shift counter 276 may count the number of times that the position defining pixel coordinates PDC are matched with respect to each of the predetermined reference coordinates RC1 to RC6 and may store counted values in the memory 300. For example, the shift counter 276 may calculate the reference coordinates corresponding to the position defining pixel coordinates PDC from the shifted first image data SADD and store counted values CRC for the corresponding reference coordinates in the memory 300.

The memory 300 may include accumulated counted values for each of the reference coordinates RC1 to RC6. Based on the accumulated counted values of the reference coordinates RC1 to RC6, degree of stress, deterioration deviation, and the like of the pixel unit 100 may be additionally calculated. In an embodiment, the image shifter 270' may control the shift of the first image IM1 based on the accumulated counted values such that the first image IM1 is displayed for a longer time or more frequently in an area where the deterioration is the least significant.

Figure 5:
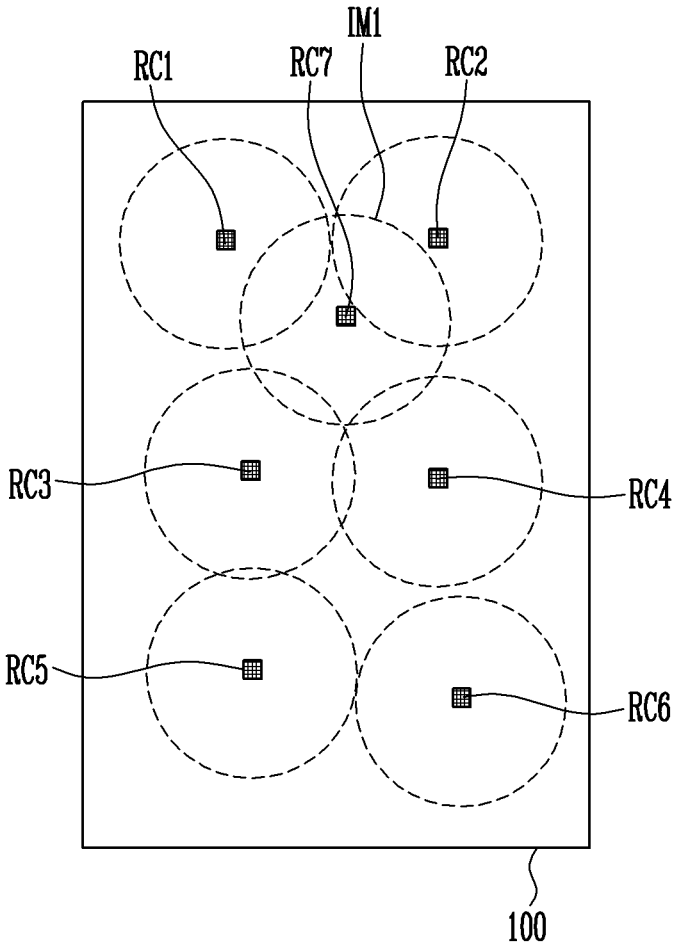
FIG. 5 is a diagram illustrating a first image displayed in the first mode according to an embodiment.

FIG. 5 is a diagram illustrating a first image displayed in the first mode according to an embodiment.

Referring to FIG. 5, in the first mode, the first image IM1 may be periodically moved within the pixel unit 100 according to a shift scenario.

In an embodiment, the first image IM1 may have a circular or elliptical shape. Reference coordinates RC1 to RC7 may be set in the shift scenario. For example, each of the reference coordinates RC1 to RC7 may be position information of a pixel positioned at the center of the first image IM1.

The position defining pixel coordinates PDC of the first image IM1 may be moved in a predetermined order according to the reference coordinates RC1 to RC7.

Figure 6:
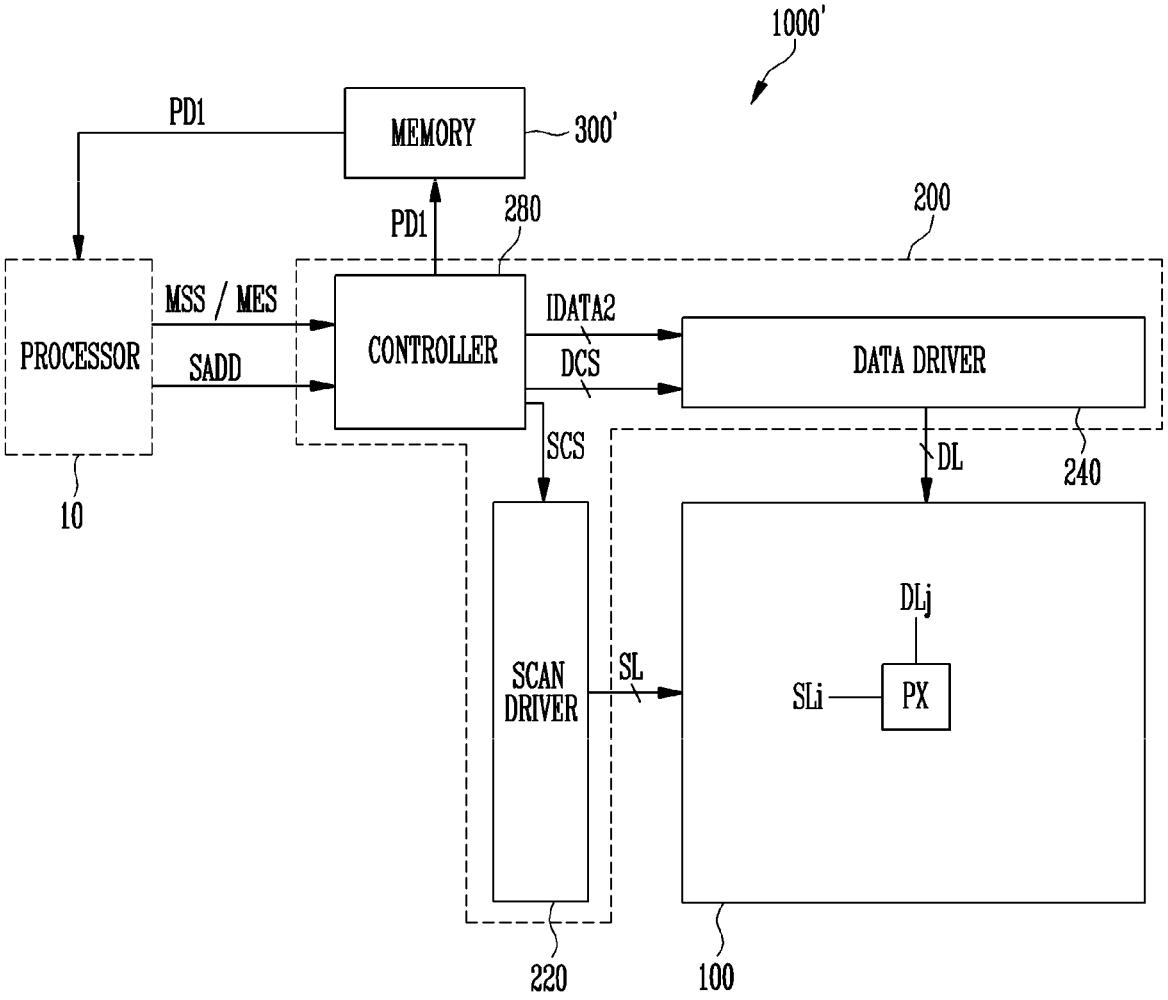
FIG. 6 is a block diagram illustrating a display device according to an embodiment.

FIG. 6 is a block diagram illustrating a display device according to an embodiment.

In FIG. 6, the same reference numerals may be used for the elements described with reference to FIG. 1. A display device 1000' of FIG. 6 may have a configuration substantially the same as or similar to that of the display device 1000 of FIG. 1 except for a configuration in which image data is shifted.

Referring to FIG. 6, the display device 1000' may include the pixel unit 100, the driver unit 200, and a memory 300'.

The display device 1000' may display an image according to commands and data supplied from the external processor 10.

The pixel unit 100 may operate in a first mode and a second mode. The pixel unit 100 may display a first image (e.g., a continuously on display image) in the first mode and may display a second image (e.g., a normal image) in the second mode.

The driver unit 200 (or the panel driving unit) may supply data signals corresponding to the first image to the pixel unit 100 in response to the first mode start signal MSS. The driver unit 200 may generate the first position data PD1 including the position information of the first image in response to the first mode end signal MES. The first position data PD1 may be stored in the memory 300'.

When the first mode is resumed or started, the memory 300' may provide the first position data PD1 to the processor 10.

The processor 10 may perform a shift operation of the image data and supply the shifted image data SADD to the driver unit 200 (for example, a controller 280 included in the driver unit 200). In an embodiment, when the first mode is resumed or started, the processor 10 may read the first position data PD1 from the memory 300' and shift the image data to a position where the first image is to be displayed based on the first position data PD1.

The shift operation of the image data may be performed by the processor 10, and the controller 280 may convert the shifted image data SADD into the image data IDATA2 suitable for driving the data driver 240. No image shifter may be included the driver unit 200, so that the burden, circuit complexity, and size of the driver unit 200 for performing the shift operation may be minimized.

Figure 7:
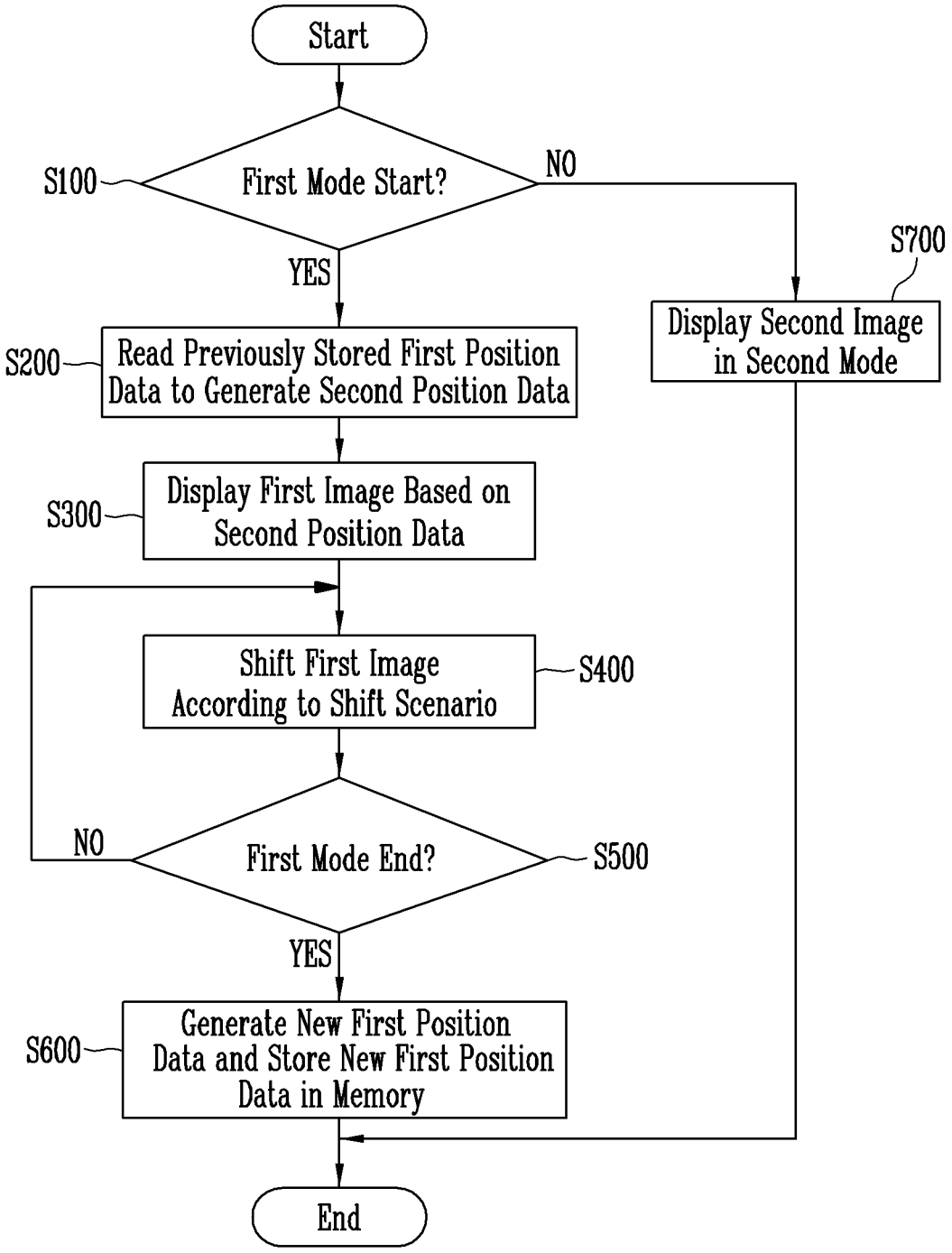
FIG. 7 is a flowchart illustrating a method of driving a display device according to an embodiment.

FIG. 7 is a flowchart illustrating a method of driving a display device according to an embodiment.

Referring to FIG. 7, a method of driving a display device may include a first mode for shifting and displaying a first image and may include a second mode for displaying a second image as a normal image. The first image displayed in the first mode may be a continuously on display image. For example, the continuously on display image may include simple image information such as date, time, battery level, and the like.

In the second mode, the second image may be displayed according to a user's command (S700).

In an embodiment, when (a session of) the first mode is started in response to a first mode start signal (S100), first position data may be read from a memory to generate second position data (S200). The first position data may include position information of the first image that was displayed when a previous session of the first mode ends. The second position data may be a position where the first image is to be initially displayed when the current session of the first mode is started.

For example, the second position data may include information of second coordinates corresponding to a position to which the first image is shifted (from first coordinates corresponding to the first position data) according to a predetermined shift scenario.

Thereafter, the first image may be displayed based on the second position data in the current session of the first mode (S300). During the current session of the first mode, the first image may be shifted according to the shift scenario until the current session of the first mode ends (S400).

The first mode may end in response to a first mode end signal (S500). In response to the first mode end signal, new first position data including the position information of the first image currently being displayed may be generated and stored in the memory (S600). Thereafter, when the first mode is resumed, the new first position data may be used to generate new second position data.

A display device according to embodiments and a related method may store the position of the first image at the end of a session of the first mode, for determining the position of the first image when the first mode is resumed. Therefore, even if the activation and deactivation of the first mode are repeated, the continuity of the shift scenario can be maintained, and the cumulative usage amount of the pixels for displaying the first image in the first mode can be substantially uniform. As the deterioration deviation between the pixels may be minimized, the afterimage of the first image may be prevented or minimized.

Example embodiments have been disclosed. Various modifications and variations to the example embodiments are possible without departing from the scope set forth in the claims.

What is claimed is:

1. A display device comprising:

a pixel unit displaying a first image in a first mode and displaying a second image in a second mode;

a driver unit electrically connected to the pixel unit, providing data signals corresponding to the first image to the pixel unit in response to a first mode start signal, generating first position data including position information of the first image in response to a first mode end signal, and enabling the pixel unit to shift the first image in the first mode based on information related to cumulative usage amounts of areas of the pixel unit;

a memory electrically connected to the driver unit and storing the first position data;

data lines electrically connected to the pixel unit; and scan lines electrically connected to the pixel unit, wherein the driver unit comprises:

an image shifter shifting first image data corresponding to the first image according to a predetermined shift scenario in the first mode;

a data driver converting the first image data to the data signals and providing the data signals to the pixel unit through the data lines; and a scan driver providing scan signals to the pixel unit through the scan lines, and wherein the image shifter comprises:

a shift counter counting a number of occurrences that values of a position defining pixel coordinate set, which define positions of the first image, match each of reference coordinate sets, wherein the memory stores the number of occurrences.

2. The display device of claim 1, wherein the first position data corresponds to a position of the first image in the pixel unit when a session of the first mode ends.

3. The display device of claim 2, wherein the first position data corresponds to one set of the reference coordinate sets of the pixel unit determined according to the predetermined shift scenario.

4. The display device of claim 3, wherein the driver unit provides signals for the pixel unit to shift the first image in an order corresponding to the reference coordinate sets during a current session of the first mode.

5. The display device of claim 3, wherein the memory is a non-volatile memory.

6. The display device of claim 1, wherein a last position of the first image displayed in a previous session of the first mode is different from a first position of the first image displayed in a current session of the first mode that is subsequent to the previous session of the first mode.

7. The display device of claim 1, wherein the driver unit loads the first position data from the memory in response to the first mode start signal, and wherein the driver unit uses the first position data to generate second position data that determines a position at which the first image is to be displayed when the first mode resumes.

8. The display device of claim 7, wherein the driver unit determines the position of the first image according to the second position data in response to the first mode start signal.

9. The display device of claim 7, wherein the driver unit enables the pixel unit to shift the first image according to the predetermined shift scenario, starting with coordinates corresponding to the second position data during a current session of the first mode.

10. The display device of claim 7, wherein the second position data includes second coordinates different from first coordinates according to the predetermined shift scenario, wherein the first coordinates correspond to a last position of the first image in an immediately preceding session of the first mode.

11. The display device of claim 1, wherein the image shifter further comprises:

a position data generator obtaining the first position data from the memory in response to the first mode start signal and using the first position data to generate second position data that determines a position at which the first image is to be displayed; and a shifting updater shifting the first image data according to at least the second position data.

12. The display device of claim 11, wherein in the first mode, the shifting updater generates shifted first image data for shifting the first image according to the predetermined shift scenario, starting with a reference coordinate set corresponding to the second position data.

13. A display device comprising:

a pixel unit displaying a first image in a first mode and displaying a second image in a second mode;

a driver unit electrically connected to the pixel unit, providing data signals corresponding to the first image to the pixel unit in response to a first mode start signal, generating first position data including position information of the first image in response to a first mode end signal, and enabling the pixel unit to shift the first image in the first mode; and a memory electrically connected to the driver unit and storing the first position data, wherein the first position data corresponds to one set of reference coordinate sets of the pixel unit determined according to a predetermined shift scenario, and wherein the driver unit counts a number of occurrences that values of position defining pixel coordinates, which define positions of the first image, match each of the reference coordinate sets, and wherein the memory accumulates and stores the number of occurrences.

14. The display device of claim 1, wherein the pixel unit displays a continuously on display image in the first mode, and wherein power consumption of the pixel unit is lower in the first mode than in the second mode.

* * * * *